United States Patent [19]

Asfour

[11] 3,939,983

[45] Feb. 24, 1976

[54] APPARATUS FOR SORTING TOBACCO LEAVES

[76] Inventor: Emil S. Asfour, 21 Wengirain, 8704 Herrliberg, Switzerland

[22] Filed: Sept. 20, 1974

[21] Appl. No.: 507,699

Related U.S. Application Data

[63] Continuation of Ser. No. 235,169, March 16, 1972, abandoned.

[52] U.S. Cl. ..... 209/73; 209/74 R; 209/111.7 R; 250/223 R; 356/201; 209/111.6

[51] Int. Cl. ..... B07c 5/342

[58] Field of Search ..... 250/223 R, 217 R; 209/111.5–111.7, 73, 74; 356/201–206, 209, 212, 173, 178, 179, 186, 219, 221, 229, 230

[56] References Cited

UNITED STATES PATENTS

| | | | |
|---|---|---|---|
| 3,455,637 | 7/1969 | Howard | 356/205 X |
| 3,515,273 | 6/1970 | Seaborn | 209/111.7 |
| 3,628,657 | 12/1971 | Billett | 209/111.7 |
| 3,771,879 | 11/1973 | Chambu et al. | 356/201 |
| 3,782,544 | 1/1974 | Perkins | 209/111.6 |

*Primary Examiner*—Allen N. Knowles

[57] ABSTRACT

Improved apparatus for grading and sorting of tobacco wherein the tobacco is dropped onto a continuously moving conveyor from which it is passed over an end plate and is scanned by one or more detectors suitably located in a housing mounted above the end plate, the detectors producing a signal indicative of the reflectivity of the desired tobacco leaf which signal controls an ejection system for separating the desired from the undesired leaf. The invention includes new structure for the end plate, detector housing and light source housing.

29 Claims, 6 Drawing Figures

APPARATUS FOR SORTING TOBACCO LEAVES

This is a continuation of Ser. No. 235,169, filed Mar. 16, 1972, now abandoned.

BACKGROUND OF INVENTION

The present invention relates to an apparatus for sorting and processing tobacco leaves and in particular to an apparatus for sorting and grading tobacco leaves providing improved means for optically sensing leaf of a selected color.

In the tobacco industry, it is necessary to grade tobacco leaves according to various standards such as color, size, type, etc. Such grading has, until recently, been done entirely by hand by individuals who stand before moving conveyor belts in which the leaves are carried from a central loading point and who are required to manually remove from off the conveyor the unwanted leaves i.e., those leaves of the wrong color, texture and/or degree of uniformity. Due to the large quantity of leaves that must be graded in a given season, the short period of time during which the individual can observe the leaves as they pass by him on the conveyor, the lack of trained grading personnel etc., there results that many unwanted leaves pass by unobserved.

Recently a number of automatic methods have been proposed for sorting and processing tobacco leaves. In U.S. Pat. No. 3,368,568, there is disclosed a grading apparatus for tobacco leaf which makes use of the differential centrifugal force developed in a leaf as between its heavier stem and lighter tissue to orient the leaf in a predetermined direction and then uses centrifugal force on the oriented leaf to maintain the leaf in a precisely located vertical plane as it passes by a grading station where photo-electric sensing means differentiates the passing leaves according to the presence or absence of a given quality. An air ejection system is provided to remove any sensed improper leaf. This system, however, suffers from the disadvantage that a large turntable is required in order to provide sufficient room for adequate separation.

According to a later patent, U.S. Pat. No. 3,380,460, a grading apparatus for tobacco leaf is provided, which effects an automatic ejection of unwanted leaves by the use of photoelectric sensing means dictating to a leaf ejecting apparatus through an electronic signal differentiating device, in which a linear table is employed dropping leaf through a number of gates. The latter system has the disadvantage of a complicated and complex table and gate arrangement.

More recently, an apparatus has been proposed wherein the electronic and photo-detection system enables the feeding of tobacco to a flat linearly moving belt. However, here too, the tobacco pieces must be separated by a given distance from its preceding and succeeding piece.

At the front end of the belt the tobacco passes over an end plate and is scanned by one or more detectors located in a housing mounted above the table. The detectors are equipped with a testing member for the color of the individual leaves and with a signalling member controlled by the testing member for indicating the color class for the actuation of the classifying device for the leaves.

The disadvantages of this apparatus are associated with the nature, arrangement and positioning of the end plate with respect to the conveyor, the plate being curved somewhat and spaced from the conveyor resulting in the accumulation of leaves in the space with resultant jamming of the apparatus, in turn necessitating interruptions for cleaning out the space before further processing can be carried out. Further, optical testing devices selectively responding to the color of leaves have the disadvantage that they must continuously be adjusted with respect to the color on the basis of which the classification is being carried out. This also involves interruptions in operation to permit the necessary adjustments and in many instances also prolongs the classification process.

In our copending application to which the reference can be made, entitled "Method and System for Grading Articles to Color", Ser. No. 235,342, filed on Mar. 16, 1973, and now abandoned in favor of a continuation application Ser. No. 497,649, filed on Aug. 15, 1974, and allowed on Feb. 21, 1975, an improved photodetection system and apparatus are disclosed in which the light transmissivity or remission of the tobacco leaf is sensed rather than its intrinsic color. This system is far simpler, more efficient and inherently faster than any known system.

It is the object of the present invention to provide certain structural devices for use with the system described in the foregoing application. In particular it is the object of the present invention to provide an improved end plate, an improved transmissivity or remission guide and criteria, an improved light source for illuminating the end plate, an improved housing for the detection system and an improved detection system as well.

It is another object of the present invention to overcome the defects of the prior art and to provide an improved tobacco leaf grading table for use with the device of the aforementioned application.

These and other objects of this invention will become apparent from the following detailed description.

SUMMARY OF INVENTION

According to the present invention a testing member for a photo-detection system is provided which is capable of being adjusted to preselected levels of light transmission. Preferably, the testing member is provided in conjunction with a tobacco vegetable, or other leaf grading system comprising a conveyor for moving leaves, a photo-detector spaced above the conveyor in line with the testing member and having means for sensing the remission value of the light transmitted from the end plate.

In accordance with further features of the present invention, the testing member comprises an end plate assembly which is movably mounted at the end of the conveyor so as to be sensitive to accumulation of leaf at that point. It also includes a tiltable member overlapping the end of the conveyor to permit passage of leaves.

A particular aspect of the invention resides in forming the end plate of a pair of overlapping shiftable members, one in white having a plurality of holes, the other with block dots. The plates are reciprocatable with each other to vary the degrees of black and white thus varying the remission or transmissive light levels at preselected degrees.

A still further aspect of the present invention resides in the container for mounting the necessary illuminating lights and the photo-detectors. According to this invention this is accomplished in a single housing sectioned to provide a pair of light banks about a central row of detectors.

Preferably, the light banks are arranged to be easily slidable into and out of the housing. The detectors are built in individual sealed assemblies and hel in individual holes, also permitting their easy installation and removal.

Full details of the present invention will be found in the following disclosure and the accompanying drawings.

DESCRIPTION OF THE INVENTION

In the heretofore known systems, the end plate served to provide a contrasting background for the leaves and a reference color against which to measure or compare the color of the leaves. Selection of this end plate depended on the desired color of the final product, and required that there by present a suitable range of reference color end plates. Trained personnel were required for selecting the correct plate, removing the one no longer needed and installation of the new plate. This situation contributed, in great extent, to the inefficiency of the known grading apparatus. Also, as already noted, the known end plates were convexedly curved (upwardly) in order to facilitate the desired classification and this acted to further accentuate the break or gap between the conveyor and the end plate. This gap allowed leaves to fall therebetween, becoming covered up with other leaves until a ridge of leaves formed, which interfered with the movement of subsequent leaves and ultimately causing a jamming of the device.

As will be seen by reference to our copending application Ser. No. 235,342 filed on Mar. 16, 1973, and now abandoned in favor of a continuation application Ser. No. 497,649, filed on Aug. 15, 1974, and allowed on Feb. 21, 1975, entitled "Method and Apparatus for Photo-electrically Grading Leaf Tobacco", such a plurality of color plates are no longer necessary. According to the invention described therein, only a single plate having defined light transmissivity or remissivity is required. Such a plate seems only to establish the initial definition of a predefined grade and thereafter seems merely as a table portion over which the leaf moves.

Figure 1:
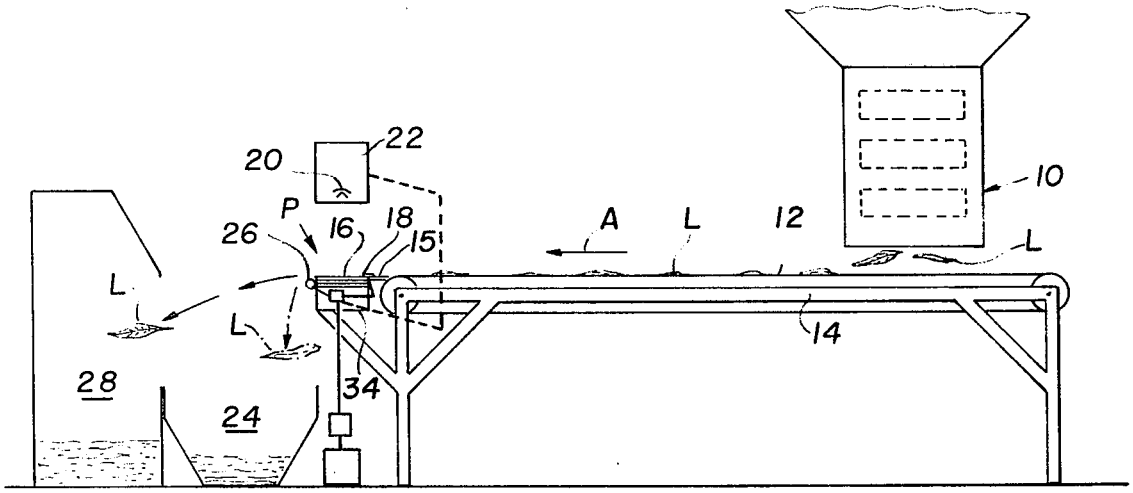
FIG. 1 is a side view of the leaf sorter and separator embodying the present invention.
Figure 2:
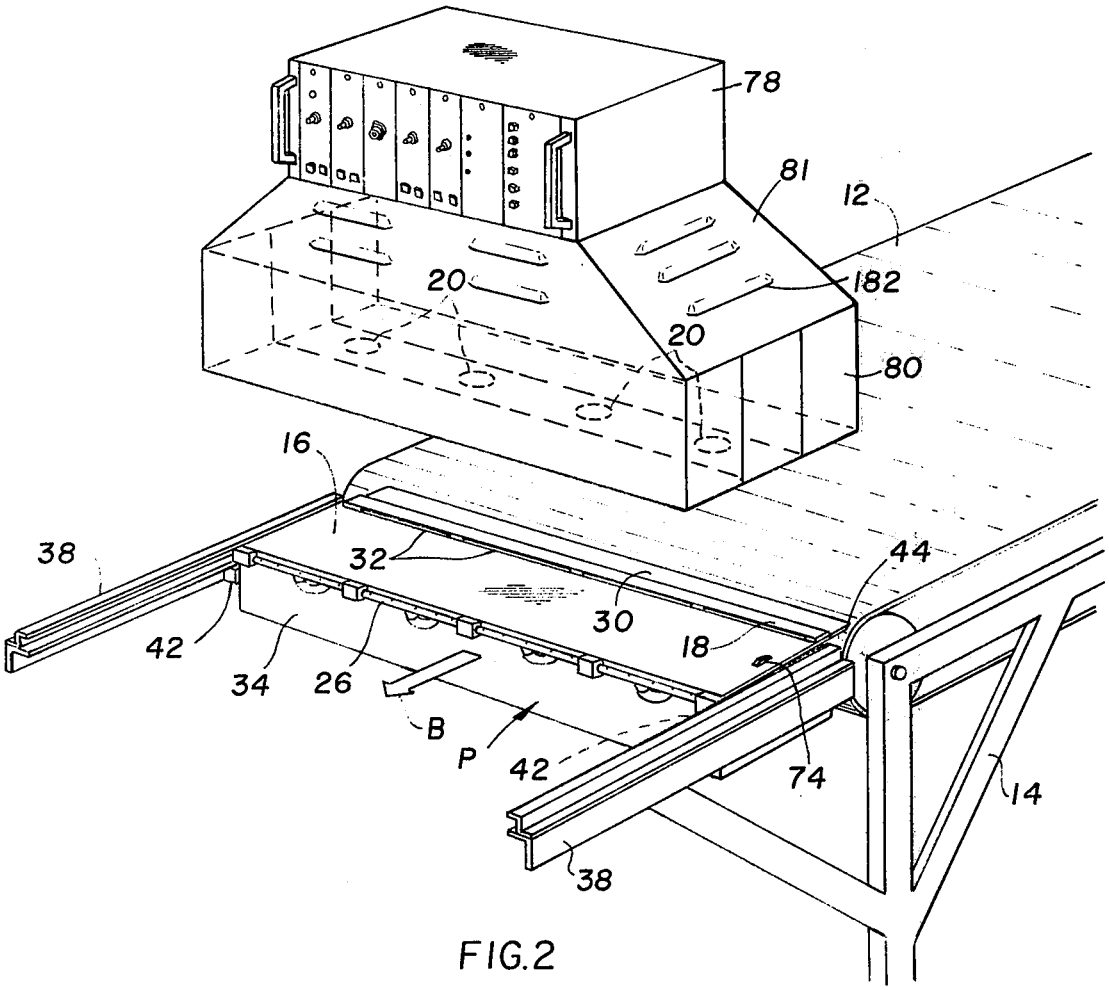
FIG. 2 is a front view of the device showing the relationship of the conveyor, end plate and detector.

In general the apparatus of the present invention is seen in the illustrative embodiment of FIGS. 1 and 2. Tobacco leaves which may be whole, cut tips or butts or particles of threshed or unthreshed leaves are fed to a feeder 10 from which they are dropped onto an endless conveyor belt 12 mounted on a stationary table 14 for movement in the direction of the arrows A. In general, the feeder and conveyor are similar to corresponding units found on conventional "picking" tables. At the front end of the conveyor belt 12, the tobacco passes over an end plate assembly P comprising a substantially flat surface 16. The rear end portion 18 of the end plate assembly P is mounted so that it can be tilted in an upward direction. The end portion is disposed so that it projects over and just short of contiguous contact with the end portion of the conveyor belt 12. The tobacco passing over the end plate is scanned by one or more detectors 20 suitably located in a housing 22 mounted above the table. The leaf and plate surface 16 is illuminated by light banks B arranged in conjunction with the detectors 20. The detectors are more fully disclosed hereinafter and in our aforementioned copending application, produce a signal indicative of the transmissivity of the desired tobacco leaf L. The desired tobacco leaf L is caused to drop into a near hopper 24 while the undesirable tobacco leaf is blown by an air jet associated with the respective detector 20 and mounted in front of and below the plate surface 16 into a far hopper 28. The rear end portion 18 of the assembly P is connected to a transverse bar 30 which is provided with air jets 32 arranged in correspondence wth respective detectors and prepointed in a downward direction towards the surface 16. The rear jets 32 serve to remove any dust, dirt, dried grass or leaf debris present on the plate thus ensuring accurate detection, and to blow air in synchronism with the forward jets 26 to provide an auxiliary blast on the "tail" of the tobacco L.

In operation, tobacco is delivered in a continuous stream of heavy mass by an overhead conveyor and deposited on the infeed conveyor of the distributor device 10. The distributor device is conventional and suitable, humpback conveyor system, such as are now common in tobacco processing plants may be employed. In any event, it is to be assumed for the purpose of this disclosure, that the tobacco is distributed on the conveyor belt 10 in random, spaced arrangement. It will be appreciated that the only criteria being that a substantially statistically high portion of the leaf be in spaced, non-contiguous individual relationship with each other so that the leaf may more or less individually pass the photo-detector.

Figure 3:
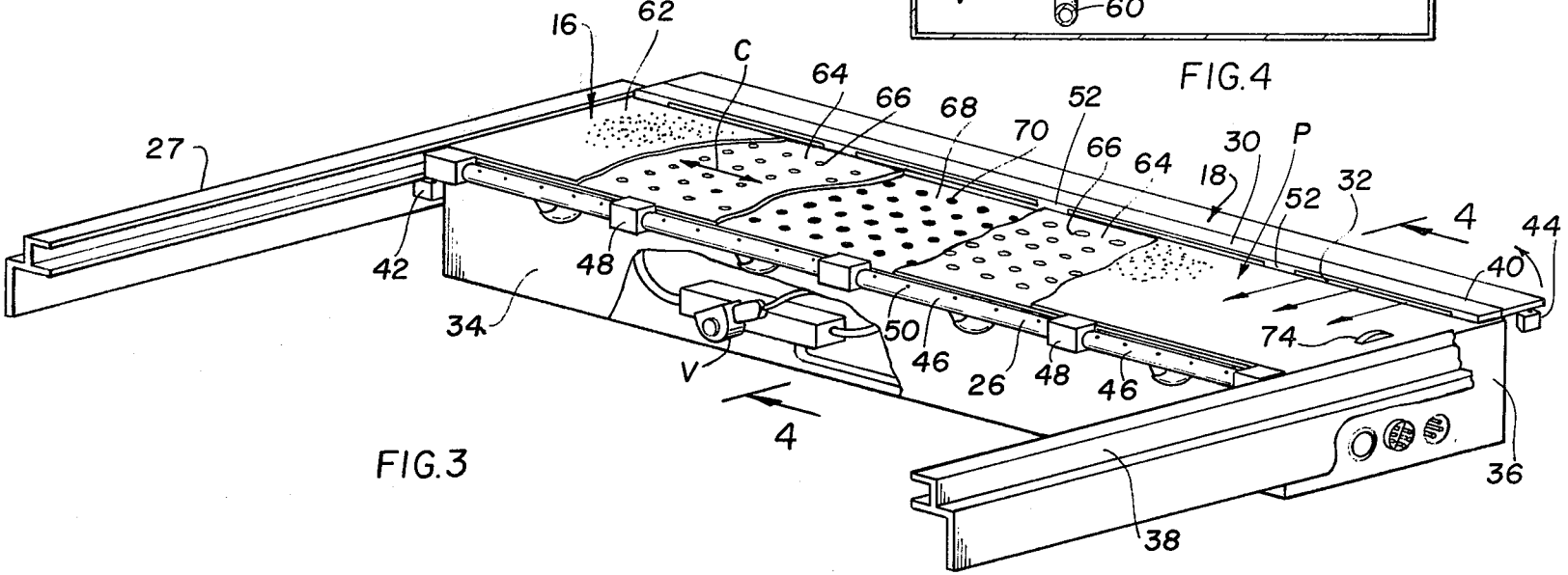
FIG. 3 is an enlarged detailed view of the end plate and the means for mounting the same.
Figure 5:
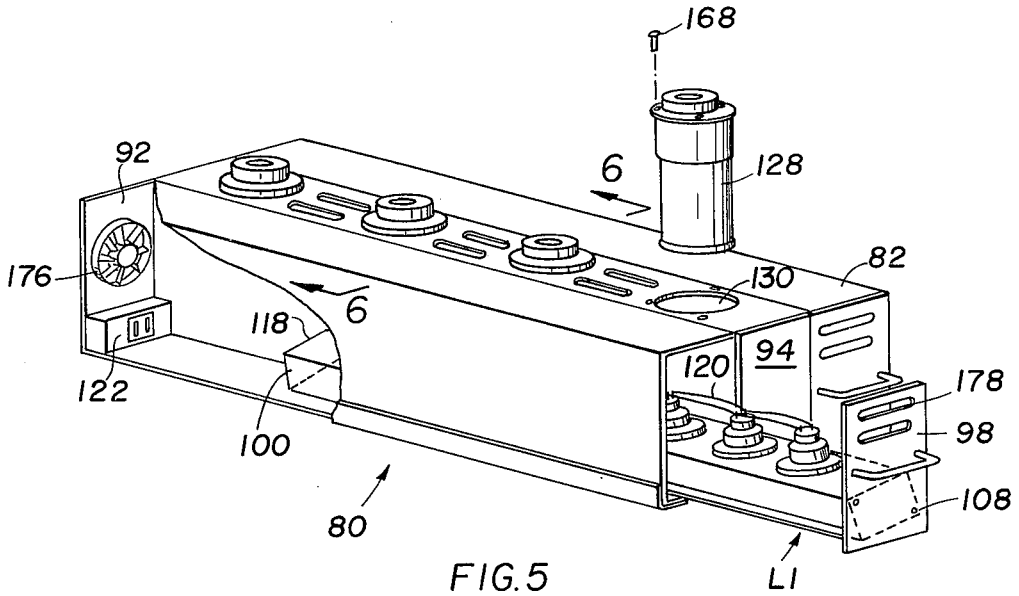
FIG. 5 is an enlarged detail of the housing showing the light source and detection systems according to the present invention.

Turning to FIG. 3 the specific construction of the end plate assembly P is shown, comprising a box like housing structure 34 having six enclosing walls provided with suitably bevelled, turned or enlarged edge portions 36 at its sides which edge portions are received in suitable corresponding channel or rail means 38 for sliding movement therein. The rear portion 18 is pivotally mounted to the bar 30 by piano hinges 40 or the like. The bar 30 is securely fixed to the rearmost upper edge of the housing so that the tiltable portion 18 is disposed in overlapping relationship with the adjacent conveyor 10 to permit the uninterrupted movement of the tobacco leaves from the conveyor belt onto the end plate surface 16 without interfering the movement thereof. The tiltable nature of the end plate at its overlapping edge portion facilitates the smooth transition from the curved portion of the belt.

Microswitch means 42 of a common type are provided to ensure proper seating of the housing 34 in the channel or rail means 38. The switches have spring contacts which sense the proper seating of the housing 38 and detect any movement in the direction of the arrow B. Since the housing is set in place by pushing it forward on the rail 38 any tobacco jam or accumulated tobacco beneath the tiltable portion 18 or in space between the belt 12 and housing 34 will tend to push it back outwardly in the direction of arrow B. This movement created by the force of the interfering tobacco jam will be sensed by the microswitches 42. Thus, even the remote possibility of jamming due to leaf accumulation or the like occur, which might prevent serious interference with the further operation of the sorting apparatus can be quickly terminated since the microswitch may be suitably connected in the conventional manner to an alarm such as a bell, buzzer, blinking or steady light for signalling the disengagement of the housng 34 from the contiguous position in front of conveyor 12 and to means by which interruption in the operation of the sorting device can be effected. The leaf accumulation provoking such interruption can then be easily attended to and the microswitches returned to the normal working position after the housing 34 is properly repositioned with respect to the conveyor's end.

In a similar manner microswitches 44 are placed on the rear end of the rails 38 to sense the proper position of the tiltable member 18. The microswitch will also sense the lifting of the member 18 due to improper movement or positioning of the tobacco on the belt and the signal thus obtained may, in the manner relating to switch 42, give alarm and stop operation of the picking table, feeder, etc.

It is contemplated that each of the testing or scanning devices 20 includes a photo sensor or light interpreting means of a type adapted for determining the transmissivity of the tobacco leaves. The optical testing device 20 is selectively responsive to the transmissivity of the leaves located on the end plate surface 16, and cooperates with a signal producing device to supply a voltage signal proportional to the light remission of the leaf passing beneath it. The electrical signals are adapted to actuate valves V to direct the desired tobacco leaves into the near hopper 24 while the undersiable tobacco leaf is blown by the air jets into the far hopper 28. The proportional voltage signals pass via gate and trigger circuits described, for example, in the aforementioned application, where a pulse is obtained dependent upon whether bad leaf is sensed. As seen more clearly in FIGS. 3 and 4, the forward jets 26 are arranged along a common axis each comprising a hollow tubular member 46 journaled within a solid bearing mount 48 so as to be capable of being swivelled about the common axis. Each jet 26 has a row of holes 50 which are spaced along the length of the tube 46. As seen, it is convenient to arrange the width of the picking table with four sets of detectors 18, and corresponding rejection jets 26. The detectors, as is well known, will scan a defined area of the plate surface 16, consequently, each jet 26 is provided with a tubular member 46 of a length substantially equal to transverse dimension of the scanning area. The solid journal blocks 48 separate each tube 46 so that each may be activated independently of the others. Similarly, the rear jets 32, formed in the bar 30 are separated by partition means 52 into four independent sections corresponding to the front jets and the detectors in size and position. Arranged within the housing 34 are four solenoid actuated air valves V each of which, on receipt of a signal pulse from the gate-trigger circuit, via a line 54, is adapted to pass a pulse, blast or short burst of air synchronously through conduits 56 and 58 to the front and rear jets 26 and 32 respectively. The valves V are connected via a conduit 60 or manifold to a source of pressurized air such as an accumulator or pump.

For example, if a leaf passes under one of the scanning devices 20, the light remission of which corresponds to the quality of the desired leaves, the signalling device will maintain the corresponding valve V in closed position and the leaf will be permitted to drop into the near hopper 24. However, if the leaf passing under the scanning device 20 registers a light transmission indicative of an undesired leaf, the signalling unit will open the corresponding valve V, enabling a jet of air to be produced in the upward direction from the corresponding air nozzle 26 and synchronously from the corresponding rear nozzle 32 whereby the undersirable tobacco leaf is blown into the far hopper 28.

Figure 4:
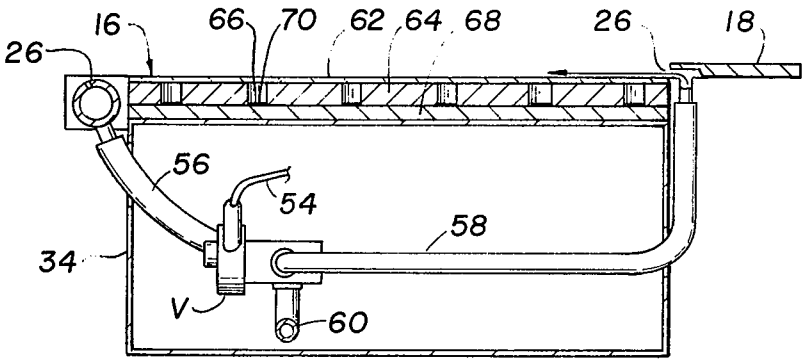
FIG. 4 is a section of the end plate of FIGS. 1 and 4 taken along line 4—4.

The plate surface 16 is actually an assembly of flat plate members designed to provide means for selecting and varying the light transmission beneath the detectors to establish and define a predetermined grade to be sensed. Referring now to FIGS. 3 and 4, the end plate 16 is formed of three separate and distinct layers, a top layer 62 made of glass which has been etched or sand blasted so as to permit the maximum light diffusion. The glass layer is sealed within the housing 34 to protect the underlying layers and the interior from contact with tobacco dust and particles which contain abrasive materials. A second or middle layer 64 which is black and which is perforated with a plurality of holes 66 over its entire surface and a third or bottom layer 68 which is white and is provided with black dots 70 are located beneath the glass. The second and third layers 64 and 68 are arranged in matched superposed relationship so that the openings or perforations 66 in the second layer and the dots 70 of the third layer substantially coincide. The second layer 64 is movable with respect to the other layers in the direction of the arrow C so that the relationship of the holes 66 in the second layer may be varied from a position where they completely coincide with underlying black dots 70 to a position where only white is seen through the openings 66. For example, a knob or gear wheel 72 may be arranged at the ends of the glass plate extending through the layers and connected to cooperative gears or racks which would enable the reciprocable movement of the center layer 64. Of course, it will be obvious that the lowermost plate 68 may be made movable instead of the central plate. Furthermore, the relative disposition of the white and black layers and dots can be reversed while the holes 66 and dots 70 may be round, square, oblong or any other shape. Empirical evidence may be used to determine the best black-white arrangement desirable. It may also be possible to obtain the same transmissivity effect by the use of contrasting colors other than black and white. Although the use of contrasting colors is indicated here, it is not intended that such colors need be matched to the exact visual color of the leaf to be graded as was the case with the prior art devices.

By this means the end plate provides a readily and simply adjustable background for the leaves against which to measure or compare the transmissivity thereof. The scanning device depending on the adjustment of the layers 64 and 68 with respect to each other can then differentiate the passing leaves according to the light transmission thereof permitting classification in accordance with a predetermined scheme, all as defined in the accompanying application.

Preferably, gauge or other suitable measuring or scale means are provided for use in setting or adjusting the movable plates relative to each other, which settings correspond to predetermined light transmission values.

A single end plate assembly according to the present invention suffices for any picking table and is capable of carrying out the entire range of possible leaf grading procedures now known.

As seen in FIG. 1 the lights, photo-detection apparatus may be housed in a single overall housing package 22 capable of being mounted above the end plate by suitable brackets, post arms or other conventional means. The assembly package is formed of an upper section 78 to hold the electronic package, a lower section 80 to hold the lights and sensors in three transverse sections I, II, III and a middle section 81 as a heat shield. Of the three transverse sections the central section is adapted to secure the photo-detectors 20 while the outer sections are adapted to slidably secure removable tray-like banks $L_1$ and $L_2$ of the lamps.

Figure 6:
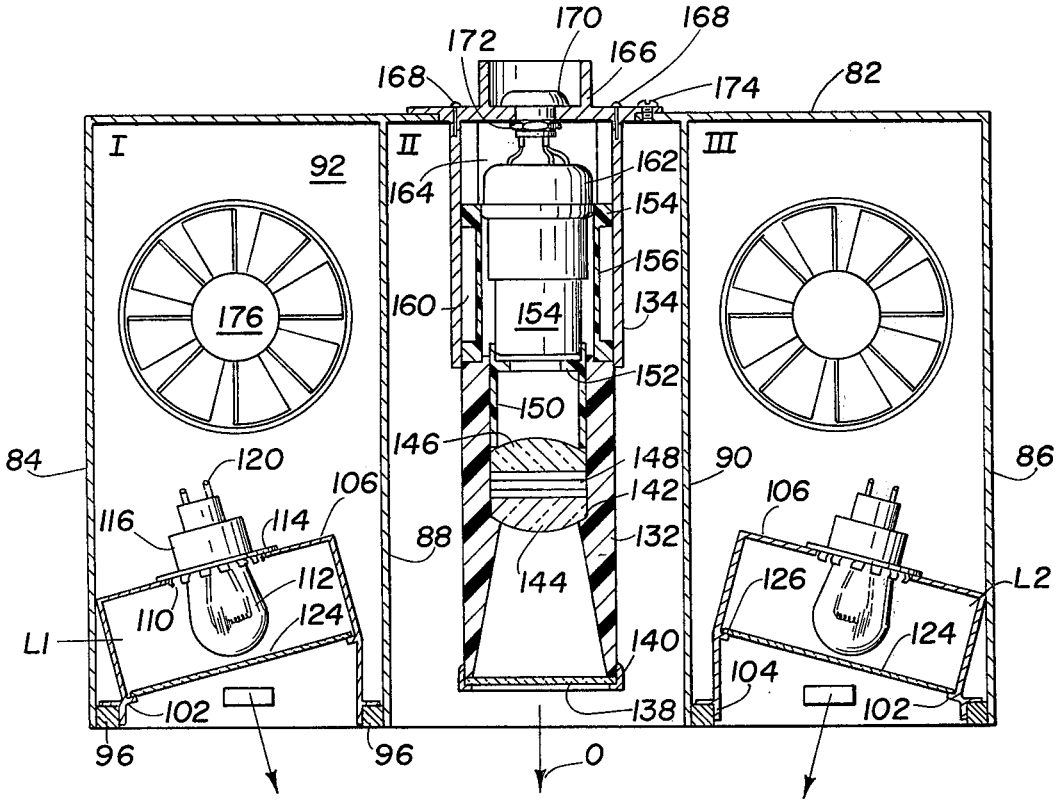
FIG. 6 is a sectional view of the systems seen in FIG. 5 taken along line 6—6 of FIG. 5.

The lower section 80 in detail, comprises a sheet metal housing constructed of a top wall 82, a pair of outer walls 84 and 86 and a pair of inner walls 88 and 90 spaced in parallel relationship uniformly from each other and integral with the top wall. The housing is completely closed at its rear by a wall 92 extending completely across its back and at its front by a small partition 94 between inner walls 88 and 90. Otherwise the housing is open at its bottom and front end. As seen in FIG. 6, the bottom edges of each of the longitudinal walls are provided with an integral ledge 96 set at right angles forming inwardly turned pairs of shelves in sections I and III between walls 84 and 88 and 86 and 90 respectively, to support the lamp trays.

Each of the lamp trays $L_1$ and $L_2$ comprise a frame formed of a front flat plate 98 and a rear flat plate 100 connected by a pair of elongated parallel runners 102 and 104 adapted to rest on the shelves 96 of each section. Secured between the front and rear end plates 98 and 100 is an elongated channel member 106 of U-shaped cross section having a flat top and angular disposed sides. The channel member is secured to the end plates 98 and 104 by screws bolts or other fastening means 108 so that the top plate is angular to the horizontal plane and the bight of the U is canted inwardly toward the vertical plane through the photo cells 20. A series of holes 110 are formed in the top plate of each U-shaped channel member into each of which a single lamp 112 is placed. Each lamp 112 is supported by an enlarged annular flange 114 covering the hole which flange is secured to the base of the lamp by an insulated, heat resistant bushing 116. The lamp 112 and flange 114 may be correspondingly threaded, or the lamp may be force fit into the flange or bushing or as is shown.

The back wall of each tray is provided with a female plug 118 from which lead connections 120 to the individual lamps 112 may be made. The back wall 92 of the housing 80 is likewise made with a mating male electrical plug 122 connected to the source of current. In this manner each tray is slidable into and out of the housing and into and out of plug engagement independent of each other. Each bank of lights, as is seen, is self contained and easily removable for replacement of one or more of the bulbs. The bulbs themselves are easily removable, being lifted from their seats within the holes in the top plate by their flanges. The wire connections can be easily accomplished by snap-in bayonet type devices.

The bottom of the U-shaped channel holding the lamps 112 is provided with a glass or translucent plastic shield 124 which acts as a light diffuser. The shield is supported within longitudinal lips 126 running the length of each wall of the channel. If desired, the translucent shield may be made of light filter material which can absorb selective light colors.

The photo detectors 20 are each housed in an assembly generally depicted by the numeral 128 which are retained in holes 130, formed in the central section II of the housing 80. As seen in FIG. 6 each photo-detector assembly 128 comprises a lower cylindrical housing 132 and an upper cylindrical housing 134 made of aluminum, glass or similar non-conductive material. A material which is heat resistant is also preferred. The upper and lower housings 132 and 134 may be threaded together or may be bolted together by suitable fasteners. The lower end of the lower housing 132 is covered by a glass shield 138 secured by an annular screw nut 140 sealing the entrance to the housing. The inner bore of the lower housing 132 is conically shaped tapering to form an upper shoulder 142 on which a lens assembly comprising a pair of convex lenses 144 and 146 sandwiched about a light filter 148. The light filter is preferably chosen of a particular wave length characteristic as set forth in the copending companion application Ser. No. 235,342 referred to earlier. The lenses 144 and 146 are conventional and are adapted to produce optimum straight line light rays from the object. The shoulder 142 and the lower lens 144 are conformingly shaped so that the filter sandwiched between the lenses lies in a plane normal to the optical axis O defined by the center of the cylindrical housing.

Mounted above the lens system 144 and 146 is a cylindrical spacer 150 having an annular horizontal inwardly directed flange 152 at its upper end on which the lower end of the photo-detector sensing head 154 sits. (The photo-detector is preferably the type described in the copending companion application.) The spacer 152 is designed to be of a length where the photo-detector sensing head presses on its upper flange 154 forcing its lower end into contact with the upper lens 146. Surrounding the sensing head 154 and interposed between it and the upper housing 134 is cylindrical shield 156 having outwardly directed flanges 158 which provide an annular air space 160 between the sensing head and the housing while holding the head secure. The upper end of the sensing head is formed with a socket terminal 162 about which another spacer 164 is located. The last spacer 164 is topped by an integral annular flange 166 secured onto the upper end of the upper cylindrical housing 134 by screws 168. A second plug socket 170 is secured on the flange 166 by a nut 172 so that connection may be made to the sensing head without entering into the assembly.

As will be obvious, the assembled parts fit forcibly together so that by tightening the screws 168 the flange is axially compressed on to the spacer 164 through which the lenses and filter are subsequently secured in axially alignment relative to the optical axis. The detectors are thus self-contained assemblies comprising a unitized integral package which is inserted within the hold 130 of the housing section II. It may be removed therefrom for repair or replacement, as desired. Each photo-detector assembly is easily disassembled and repair or replacement of lens, filter, photo sensor can be easily accomplished. To insure that the assembly is not disturbed or shifted during use, it is preferred that it be fastened by bolts 174 to the upper plate of the housing via the flange 166.

It will be noted that the material of the photo sensor assembly is preferably heat resistant, and the open area about the sensor, lenses etc., provide suitable heat sinks. It is also noted that the detector assemblies are spaced from the side walls of the housing 80 which also provides suitable heat sinks surrounding the assembly package thereof. In order to further cut down on possible heat effects, the housing 80 is provided with a pair of fans 176 at the rear end, aligned with lamp banks $L_1$ and $L_2$. The fans blow cool air across each of the lamps which air exit out of vents 178 in the front panel 98. The fans 176, if desired, may be located to blow counter to each other or even transversely across the lamp trays rather than as shown. More than two lamp banks $L_1$ may be used. As indicated in the companion application, each lamp bank may contain multiple units of lamps. The lamps may be of any kind and may be wired in any conventional manner, although banks containing low voltage lamps may be preferred. The center section housing the photo-detector is also provided with vents 180 in the top plate to permit further flow of air from beneath to rise about the photo sensor assembly housings. The mid-section 181 of the housing package also has vents 182.

Although the apparatus described in this disclosure is particularly adapted for use in the system disclosed in our application Ser. No. 235,342 now abandoned in favor of a continuation application filed on Aug. 15, 1974, Ser. No. 497,649 and allowed on Feb. 21, 1975, it will be evident that they are not limited only to that system. The end plate structure, as well as the housing package for the lights and photo-detector can each be applied with ease to many of the existing systems or even to new, not yet devised systems, for grading tobacco leaf. Furthermore, it is also evident that the end plate assembly may be used independently of the housing package. It is accordingly intended that the present disclosure be illustrative only of the present invention and the scope of the invention be limited only by the claims appended hereto.

What is claimed is:

1. Apparatus for sorting tobacco leaves, comprising a conveyor for moving leaves, an end plate comprising a substantially horizontally disposed surface over which said leaves pass, said plate being arranged in cooperation with the forward end of said conveyor to receive said moving leaves therefrom, means for resiliently mounting said end plate to be movable away from said conveyor on accumulation of leaves between said conveyor and said end plate, said end plate being adapted to provide a preselected level of light reflection, a photoelectric sensor spaced above said end plate adapted to provide a signal indicative of the reflection of light from the leaves passing over said end plate and means responsive to said signal to classify said leaves.

2. A sorting apparatus according to claim 1 wherein said end plate is arranged so that the rear end portion thereof projects over the front end portion of said conveyor belt.

3. A sorting apparatus according to claim 2 wherein said end plate portion is upwardly tiltable, with respect to the surface of said conveyor, the angle of said tilt being so chosen as not to interfere with the movement of the leaf passing from said conveyor belt onto said end plate.

4. Apparatus for sorting tobacco leaves, comprising a conveyor for moving leaves to a discharge end, an end plate comprising a substantially horizontally disposed surface arranged at the discharge end of said conveyor in cooperation therewith to receive said moving leaves passing thereover, said end plate being supported by a housing comprising a frame mounted at the end of said conveyor, said frame including a pair of laterally spaced side supports, and means for removably mounting said plate on said side supports.

5. A sorting apparatus according to claim 4 wherein said housing is mounted on said side supports for movement in a generally horizontal plane from an operative position at the discharge end of said conveyor to an inoperative position spaced axially therefrom for servicing and cleaning said apparatus.

6. A sorting apparatus according to claim 5 additionally including a microswitch for sensing the proper seating of said housing in said side supports and for sensing the forward movement of said housing resulting from leaf accumulation between said housing and said conveyor belt.

7. A sorting apparatus according to claim 6 including means responsive to said microswitch for providing a signal upon forward movement of said housing.

8. A sorting apparatus according to claim 7 wherein said signal is a visible signal.

9. A sorting apparatus according to claim 7 wherein said signal is an auditory signal.

10. Apparatus for sorting tobacco leaves comprising a linear conveyor for moving leaves, a housing mounted at the forward end of said conveyor, said housing having a pair of laterally spaced side supports, an end plate extending between said side supports on which said tobacco leaves are supported as they pass forwardly from said conveyor, a sensor spaced above said end plate adapted to provide a signal indicative of the reflection of light from said passing leaves, a plurality of first air jet nozzles secured to said housing below the front end portion thereof, said first nozzles being connected to a compressed air system responsive to a signal from said sensor to provide an air current in the forward direction through said nozzles.

11. A sorting apparatus according to claim 10 including a plurality of second air jet nozzles arranged above said housing at the rear end portion thereof, said second nozzles being connected to a compressed air system to provide an air current in the downward direction on said end plate.

12. A sorting apparatus according to claim 4 including a plurality of first air jet nozzles arranged below said housing at the front end thereof, said first nozzles being connected to a compressed air system so that an air current of adjustable force can be obtained in the forward direction through said nozzles for effecting the classifying of said leaves, and including a plurality of second air jet nozzles arranged above said housing at the rear end thereof, said second nozzles being connected to a compressed air system so that an air current of adjustable force can be obtained in the downward direction through said nozzles for cleaning said end plate.

13. A sorting apparatus according to claim 11 including electrically operable valve means responsive to a sensor signal indicative of a predetermined level of reflected light and interposed between said nozzles and said compressed air system.

14. A sorting apparatus according to claim 13 including control circuits connecting said sensor and said valve means for regulating the response of said valve means.

15. Apparatus for classifying tobacco leaves comprising a conveyor for moving leaves, a planar surface disposed in conjunction with said conveyor over which said leaves pass and a sensor spaced opposite said end plate to provide a signal indicative of the reflection of light from said leaves passing thereover, said planar surface being formed of three layers a. a topmost layer made of glass adapted for permitting maximum light diffusion, b. a middle layer which is black and which is perforated over its entire surface, and c. a bottom-most layer which is white and is provided with black markings arranged to coincide with the perforations of said middle layer when the middle layer and bottom layer are positioned in matched superposed relationship.

16. A sorting apparatus according to claim 15 wherein at least one of said middle and bottom layers is mounted in said frame for movement with respect to the other whereby the relationship of said perforations with respect to said black markings on said white bottom layer may be varied from a position where they completely coincide and provide an entire overall black appearance to one where only white is seen through said perforations to provide a generally whiter appearance.

17. A sorting apparatus according to claim 4, wherein said end plate is formed of three separate layers, a. a topmost layer made of glass adapted for permitting maximum light diffusion, b. a middle layer which is black and which is perforated over its entire surface, and c. a bottom-most layer which is white and is provided with black markings arranged to coincide with the perforations of said middle layer when the middle layer and bottom layer are positioned in matched superposed relationship and wherein at least one of said middle and bottom layers is mounted in said frame for movement with respect to the other whereby the relationship of said perforations with respect to said black markings on said white bottom layer may be varied from a position where they completely coincide and provide a black appearance through said perforations to one where only white is seen through said perforations to provide a white appearance through said perforations.

18. A sorting apparatus according to claim 16 including gauge means for use in adjusting the position of one of said middle and bottom layers corresponding to the selected reflectivity of the desired leaf.

19. A sorting apparatus according to claim 16 wherein said topmost layer is etched glass.

20. A sorting apparatus according to claim 16 wherein said topmost layer is sand blasted glass.

21. A testing member for the quality of individual tobacco leaves and adapted for determining the reflectivity of the individual leaves comprising an end plate comprising a substantially horizontally disposed leaf supporting surface in combination with scanning or detector means mounted in vertically spaced relation over said end plate wherein said end plate is supported in a box-like housing comprising a frame including a pair of laterally spaced side supports with said end plate extending between said side supports, including a plurality of air jet nozzles arranged below said housing at the front end portion thereof, said nozzles being connected to a compressed air system so that an air current of adjustable force can be obtained in the forward direction through said nozzles for effecting classifying of said leaves, said end plate being formed of three separate layers, a. a topmost layer made of glass adapted for permitting maximum light diffusion, b. a middle layer which is black and which is perforated over its entire surface, and c. a bottom-most layer which is white and is provided with black markings arranged to coincide with the perforations of said middle layer when the middle layer and bottom layer are positioned in matched superposed relationship, and wherein at least one of said middle and bottom layers is mounted in said frame for movement with respect to the other whereby the relationship of said perforations with respect to said black markings on said white bottom layer may be varied from a position where they completely coincide and provide an entire overall black appearance to one where only white is seen through said perforations to provide a mixed white appearance.

22. The apparatus according to claim 1 wherein the surface of said end plate is a combination of colors substantially different from said tobacco leaves.

23. A system for classifying tobacco leaves having a conveyor for said leaves, a surface disposed in conjunction with said conveyor and comprising a diffused combination of white and black, over which surface said leaves pass, a photoelectric sensor being arranged spacedly from said surface and being adapted to provide a signal indicative of the light level reflected thereon by the sensed leaf having thereunder the diffused white and black combined surface.

24. The system according to claim 23 wherein said photoelectric sensor is provided with means for restricting its response to a defined wave length range.

25. The system according to claim 24 wherein the means for restricting the response of said photo-sensor is limited to the sensing of light in a wave length band of substantially 660 to 680 millimicrons.

26. A system for classifying tobacco leaves having a conveyor for said leaves, a surface disposed in conjunction with said conveyor and comprising a diffused combination of contrasting colors, over which surface said leaves pass, a photoelectric sensor being arranged opposite said surface for receiving light reflected thereon and to provide a signal indicative of the level of the light reflected by the sensed leaf having thereunder the diffused background of contrasting colors provided by said surface, said surface comprising at least a pair of members each having means reflecting the levels of light of said contrasting colors, wherein at least said means reflecting said levels of light are adjustable with respect to each other to selectively vary the combined level of light reflection of said surface.

27. The system according to claim 26 wherein said photoelectric sensor is provided with means for restricting its response to a defined wave length range.

28. The system according to claim 26 wherein said members comprise plates arranged one above the other, the topmost plate being at least translucent and having a plurality of light reflecting indicia arrayed over its surface, the lower plate having a cooperating array of contrasting light reflecting indicia disposed over its surface, said plates being shiftably mounted with respect to each other to selectively vary the coincidence of the indicia on one plate with that of the other to adjust the level of light reflecting therefrom.

29. The system according to claim 28 wherein the contrasting light reflection indicia is of a color other than tobacco.

* * * * *